US007175238B1

(12) United States Patent
Barman

(10) Patent No.: US 7,175,238 B1
(45) Date of Patent: Feb. 13, 2007

(54) PROCESS AND ARRANGEMENTS FOR PRODUCING A TOOTHBRUSH, THE TOOTHBRUSH, AND ALSO THE USE OF THE TOOTHBRUSH

(76) Inventor: Rolf Barman, Marsvei 3, Bergen N-5098 (NO)

( * ) Notice: Subject to any disclaimer, the term of this patent is extended or adjusted under 35 U.S.C. 154(b) by 511 days.

(21) Appl. No.: 10/129,606

(22) PCT Filed: Nov. 10, 2000

(86) PCT No.: PCT/NO00/00378

§ 371 (c)(1),
(2), (4) Date: May 8, 2002

(87) PCT Pub. No.: WO01/33994

PCT Pub. Date: May 17, 2001

(30) Foreign Application Priority Data

Nov. 12, 1999 (NO) ..... 19995579

(51) Int. Cl.
*A46B 11/00* (2006.01)

(52) U.S. Cl. ..... 300/21; 300/2; 300/10; 300/11; 15/167.2

(58) Field of Classification Search ..... 15/167.2; 300/21, 2, 10, 11; D4/105, 106
See application file for complete search history.

(56) References Cited

U.S. PATENT DOCUMENTS 4,449,266 A * 5/1984 Northemann et al. ..... 15/167.2
5,758,380 A 6/1998 Vrignaud

FOREIGN PATENT DOCUMENTS

DE 41 15 943 11/1991
EP 0 968 672 1/2000

* cited by examiner

*Primary Examiner*—Gladys J P Corcoran
*Assistant Examiner*—Abraham Bahta
(74) *Attorney, Agent, or Firm*—Collard & Roe, P.C.

(57) ABSTRACT

A method and a device are described for manufacturing of a toothbrush from a starting-material which comprises a handle that runs into a neck part which divides into two equal and diverging arms/head parts, in which the bristle-carrying surface (bottom surfaces) of the head parts is approximately in a plane which runs parallel to the main axis of the toothbrush and head, and in which bristle which extend approximately vertically out from the surface is inserted and is of approximately equal of different lengths. According to the invention the starting-material is arranged in a shaping appliance in which the neck and head part adjacent to the respective associated arms, is supported with its underside on a support body, and the two head parts are bent, in particular by twisting/deformation, to the desired angle position by torsion-twisting of the two arms/heads along the respective axes approximately parallel to the center-line axis of the handle, approximately at the same height as the underside of the neck part, so that the edges of the head parts and the upper sides of the arms in the V-shaped opening form a head part with decreasing height towards the foremost part of the head part. The manufactured toothbrush is particularly suited to animals, in particular domestic animals, pets and especially intended for dogs and cats but can also be used by humans.

8 Claims, 4 Drawing Sheets

PROCESS AND ARRANGEMENTS FOR PRODUCING A TOOTHBRUSH, THE TOOTHBRUSH, AND ALSO THE USE OF THE TOOTHBRUSH

CROSS REFERENCE TO RELATED APPLICATIONS

Applicant claims priority under 35 U.S.C. §119 of Norwegian Application No. 19995579 filed Nov. 12, 1999. Applicant also claims priority under 35 U.S.C. §120 of PCT/NO00/00378 filed Nov. 10, 2000. The international application under PCT article 21(2) was published in English.

BACKGROUND OF THE INVENTION

1. Field of the Invention

The invention relates to a method for manufacture of a toothbrush from a starting material which is comprised of a handle which runs smoothly into a neck part that splits into two equal and diverging arms connected with their own head part, in which the bristle-carrying surfaces of the head part is predominantly in a plane which goes through the centre-line of the shaft, and in which bristles are inserted, standing, on the whole, vertically up from the plane and are of different lengths.

Furthermore, the invention is a device for manufacture of toothbrushes.

The invention also relates to a toothbrush with a handle that is connected, by way of arms, with two separate bristle-carrying head parts.

In addition, the invention relates to a special application area for the toothbrush manufactured.

The present invention relates to a toothbrush which has a shape that can be adjusted for cleaning of different types of teeth in animals and humans.

2. The Prior Art

Teeth diseases, such as tooth decay and gum disease, which result in loosening of teeth, exist among animals as well as humans. The diseases can be prevented by effective cleaning which acts against build-up of harmful layers of bacteria on the teeth. For animals and humans, a natural diet does not lead to conditions in which disease-forming layers of bacteria are encouraged, but diseases of the teeth do occur in animals and humans that do not have a natural diet. Cleaning of teeth is therefore a necessity for exposed groups of pets and domestic animals, especially dogs and cats, and humans that are subjected to layers of bacteria causing disease.

Toothbrushes with two head parts have been described and produced earlier. However, nobody has hitherto succeeded in producing a practical and acceptable toothbrush which satisfies the ideal demands that a toothbrush shall:

1) have a small compact head part.

2) enfold the whole tooth and clean accessible teeth surfaces in one go with a simple movement of the brush.

3) have a bristle shape which is adjusted for careful cleaning in the area between tooth and gum.

4) be manufactured automatically in a continuous process with inserting of the bristle and trimming of the bristle by processing of the bristle ends and bending of the head part to its final form.

Furthermore, there has for a long time been a need for a toothbrush construction in which the brush can be adjusted to the different teeth shapes of mammals, and which can keep the exposed area at the transition between tooth and gum clean. It must be possible to adjust the toothbrush to the different teeth shapes of front teeth, canines and back teeth/molars. The various teeth groups have different shapes with dissimilar lengths and thickness. A toothbrush which shall enfold the tooth and clean the whole of the tooth in one go must, therefore, be adjustable to the different teeth shapes.

A toothbrush which has such a property, as well as the way it is manufactured, is described in the following.

Previously known are toothbrushes or starting-materials for toothbrushes, which have a Y-shaped embodiment of the toothbrush blank, where the bristle groups are placed at a considerable distance apart, such as being placed in rhombus- or parallelogram shaped head parts which are connected with arms in a U-shaped, concave arch to a handle. It will be difficult to insert bristle groups into the two head parts of a starting-material of this type in an unfolded state in one simple operation, because the distance between the bristle groups is very large. In these embodiments, the bristle groups are therefore best suited to be manufactured separately in two operations.

The embodiment with the associated arms in a U-shape or Y-shape results in the toothbrushes, which have considerable distance between the head parts with the bristle groups in bent condition, will become lumpy and inappropriate to use because the head- and neck parts will take up too much space in the mouth and this means that the gap between the teeth in the upper jaw and lower jaw becomes so large that the toothbrush is unpleasant or difficult to use.

SUMMARY OF THE INVENTION

It is an aim of the invention to provide a new and compact construction for a finished toothbrush which completely, or partially, eliminates the disadvantages which are described in the introduction, i.e. that the new toothbrush construction has small external dimensions which makes it well suited to cleaning of the different teeth types which can be found in animals and humans.

The method according to the invention comprises producing a toothbrush from a blank comprising a handle portion, a neck portion and two diverging arm portions, each arm portion having a head portion with bristles, both head portions being located in a plane through a center line of said blank, and the bristles extending rectilinearly outwards from said center line. The method comprises:

placing the blank in a shaping device;

arranging a bottom side of said arm and head portions at a support body; and bending the arm and head portions via torsion twisting to a desired angle position along a respective one of two axes, the two axes extending approximately parallel to the center line of the blank and approximately level with the bottom side of said neck portion;

wherein the step of bending causes the head portions to extend in downwards diverging directions with respect to the handle and neck portions, with a top side of the head portion extending downwards from a level of the center line of the blank and with the bottom side of the head portions extending downwards from a level of the bottom side of the neck portion.

A rigid support structure can be placed in a spacing between the two downwards diverging arm and head portions, the rigid support structure having a shape approximately corresponding to a shape of the spacing. The rigid support structure may be wedge-shaped.

During the step of bending, the blank support body may have two opposed side edges running parallel to said blank center line. The step of bending can take place along contact lines of the support body.

The support body may have two mutually parallel pins having oppositely directed side faces having contact lines of the support body.

The toothbrush according to the invention has a handle portion, a neck portion, two arm portions and a bristle carrying head portion at the outer end of each arm portion, with the two arm portions being bent to form an angle of about 90° between the head portion of each arm portion. There is a support body for supporting the toothbrush blank, the support body supporting at least the arm portions during a torsion twist bending of the arm portions along contact lines provided by the support body; and means for softening relevant blank portions.

The toothbrush may have a rigid structure located in a spacing between the two arm portions and two head portions, the structure having a shape which approximately corresponds to the spacing. The rigid structure may be of a shape and selected from the group consisting of V-shaped and wedge-shaped.

The support body may have two edges extending parallel to the center line of the blank. The support body may form two contact lines to support the arm portions during bending.

The support body may comprise two mutually parallel pins supporting the arm portions with mutually opposite side lines extending along the bottom side of the blank.

In another embodiment, the toothbrush comprises a handle portion; a neck portion connected to the handle portion; two arm portions connected to the neck portion; a head portion having bristles at an outer end of each arm portion, the head portions being mutually spaced by a V- or U-shaped spacing and bristle carrying faces of each head portion diverging under an angle of 70–90°, whereas the bristles of each head portion extend rectilinearly outwards from said bristle carrying faces. An inner edge of each arm and hear portion facing said spacing has an evenly downwards diverging profile extending from the neck portion to an outer end of each head portion. The toothbrush in an original blank condition may have a maximum extension A of 3.5 cm. The toothbrush in an original blank condition may have a distance B of 1.2–1.5 cm between innermost rows of opposite bristle groups.

According to the invention, the method and device for manufacture of toothbrushes is applied to animals, and in particular to domestic animals, pets, and is especially intended for dogs, and in an embodiment smaller than that shown, also for cats. However, it can, of course, also be used by humans.

The abovementioned problems with the toothbrushes manufactured previously are thereby overcome by the present starting-material that has a shape in which the groups of bristle are placed in predominantly square or rounded head parts at a much shorter and defined distance on arms which are shaped in a convex or straight embodiment to a handle. This gives the opportunity to insert bristle in the head parts in one simple operation with the subsequent trimming of the bristle in a conventional toothbrush machine, and forms a considerable smaller and more compact toothbrush after bending of the head parts to a desired shape.

It will be possible to move the head parts with the bristle groups to and from each other because of the flexibility of the arms, and it can therefore be adjusted to different teeth thickness. As the head parts can be flexed and are placed at an angle to each other, long teeth, such as canines, will be able to extend up between the head segments and make it possible for the toothbrush to clean down at the important area of transition between tooth and gum of the long tooth.

The bending of the head parts which are placed on the arms can occur by a pressure against the reverse side (back) of the bristle-carrying head parts with a counter grip as support which leads the head parts into a desired mutual angle position by twisting and intended deforming of the arms of the head parts. The twisting occurs preferentially by each head part being twisted around an axis which runs primarily parallel to the longitudinal direction of the handle part 12 of the starting-material, and lies in a plane which goes through the handle and the two neck parts in the transition part to the bristle-carrying head parts which turn towards the centre-line between the head parts. The axis(es) of twisting parallel to the handle is (are) furthermore placed such that the arm(s) and head parts, with fastening for the innermost row of bristle, approximately keeps their position in relation to the centre axis for the handle and arms of the tooth brush, Thereby, the bending down of the arms with the head parts and the considerable increase of the combined height which characterises previously known toothbrushes with two bristle-carrying head parts, becomes almost eliminated.

The starting-material of the head parts and the associated arms consist of a plastic material which can change shape both in cold and hot condition, and which retain the elastic form when the bending has been carried out.

BRIEF DESCRIPTION OF THE DRAWINGS

The invention shall be explained in more detail in the following, with simultaneous reference to the enclosed figures, in which.

Figure 5:
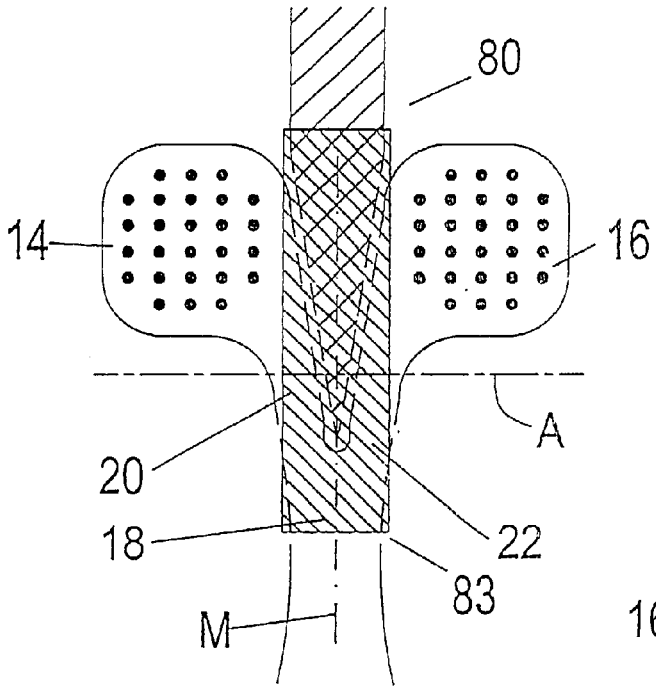
Figure 5A:
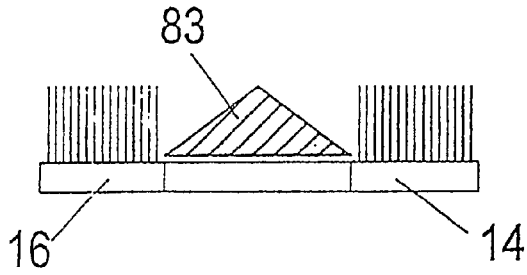
Figure 6:
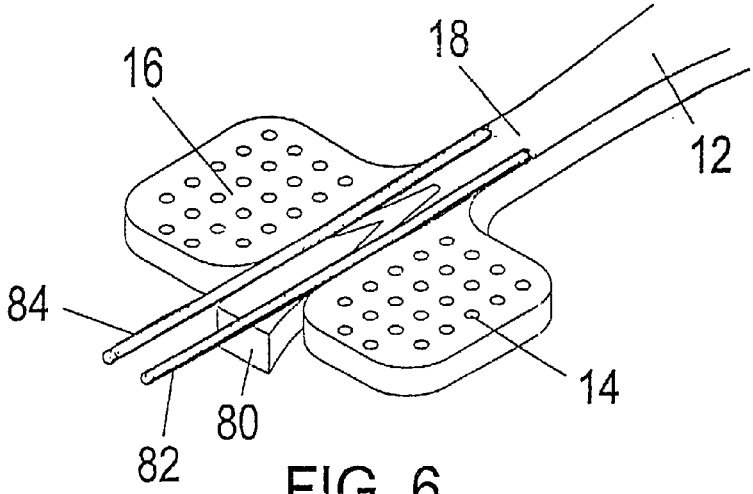

The FIGS. 5 and 6 show an appliance for forming of a toothbrush starting-material to a finished brush with two heads, with a support device being used, and a structure which fills the V-shaped space between the two head parts in the toothbrush which is to be bent, with the latter ensuring a correct distance between the head parts during the bending.

Figure 7:
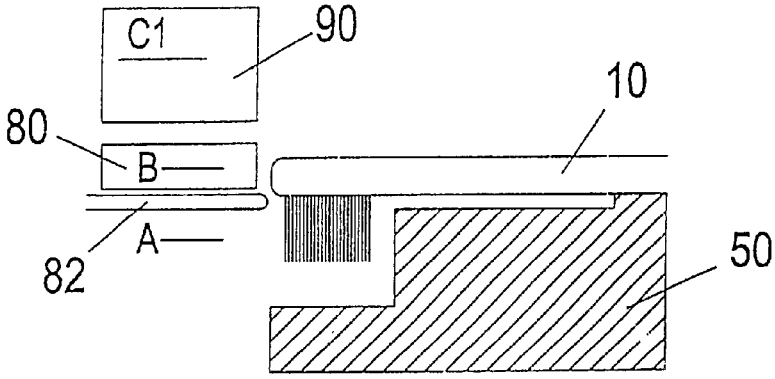
Figure 8:
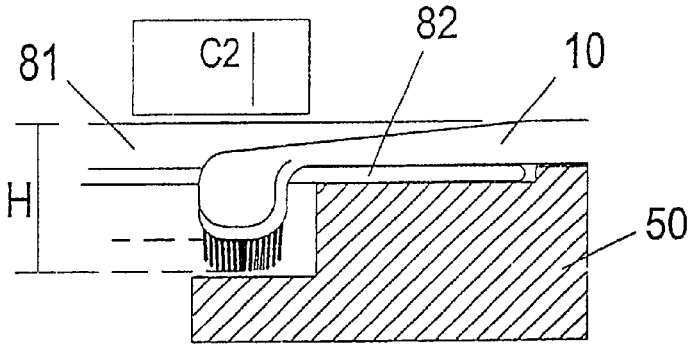

FIGS. 7 and 8 show side sections of the steps used to form the head parts of the toothbrush according to the invention.

Figure 9:
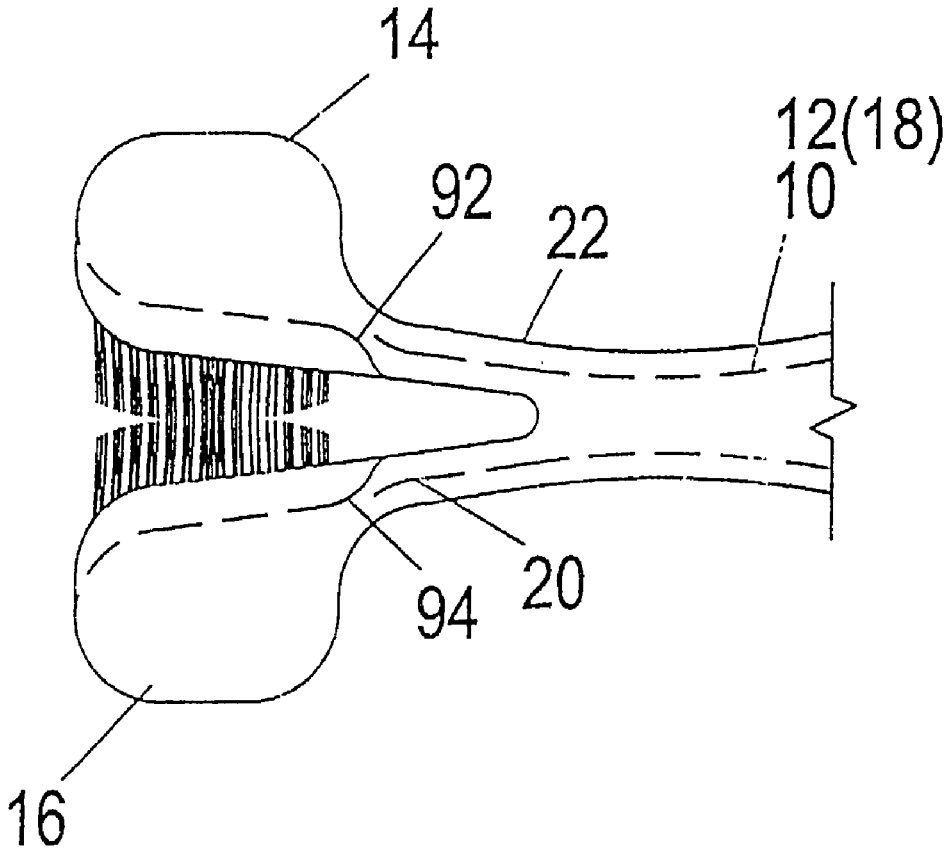

FIG. 9 shows the finished formed head of the toothbrush.

DETAILED DESCRIPTION OF THE PREFERRED EMBODIMENT

Figure 1:
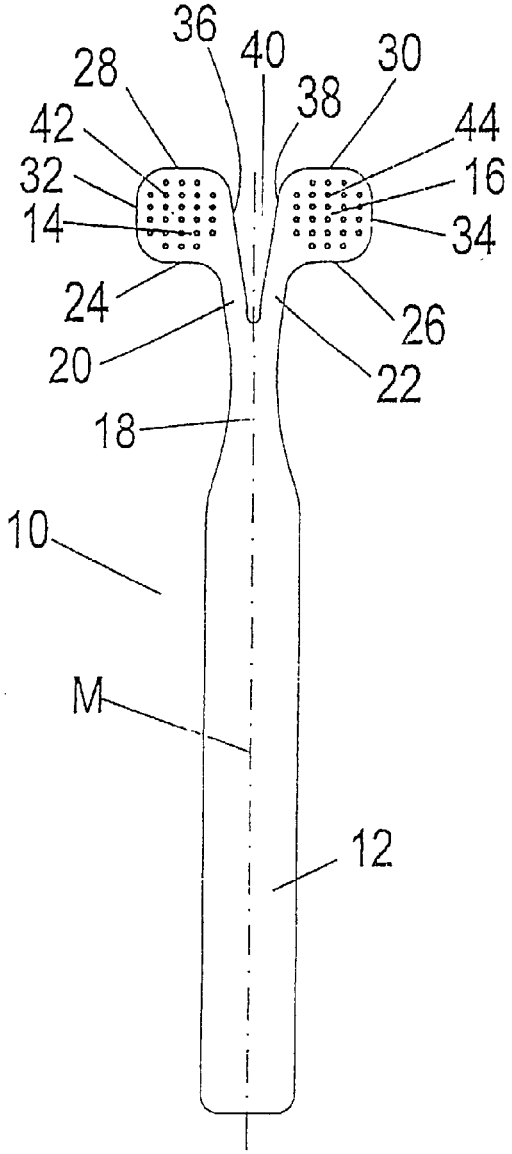
FIG. 1 shows a diagram of the toothbrush starting-material, which is used in the manufacture of the toothbrush according to the invention.

Initially, reference shall be made to FIG. 1, which shows a starting-material 10 for construction of a toothbrush. The starting-material 10 comprises a handle part 12 at the back and bristle-carrying head parts 14 and 16 at the front. The handle 12 and head parts 14, 16 are connected by way of a smoothly tapered neck part 18 which splits into two equal and diverging arms 20, 22 which are connected to their own head parts 14, 16. The head parts are at the front 28, 30 and back 24, 26 limited by approximately parallel sides which form an approximately 90° angle with the centre-line M of the starting-material and curves into the two outer sides 32, 34 which limit the outer sides of the head parts 14, 16 at a distance from the centre-line M. The inner sides 36, 38 of the head part, i.e. the sides that are situated nearest the centre-line M, run further into the two arms 20, 22 so that an approximate V-shape opening is formed. The inner sides 36, 38 run together in the dividing-line M at a distance behind the two head parts 14, 16. Furthermore, the head parts are made with a number of indentations into which the bristles 42, 44 are inserted.

For a toothbrush with a mainly straight handle, the bristle-carrying surfaces of the head parts lie in a plane which goes through the centre-line M of the handle 12, 18 or is parallel with it. For a brush which is not straight, or which is curved, the bristle-carrying surfaces of the head parts lie in a plane which is parallel to, or is at an angle to, a main plane which goes through the head part and the handle.

Figure 2:
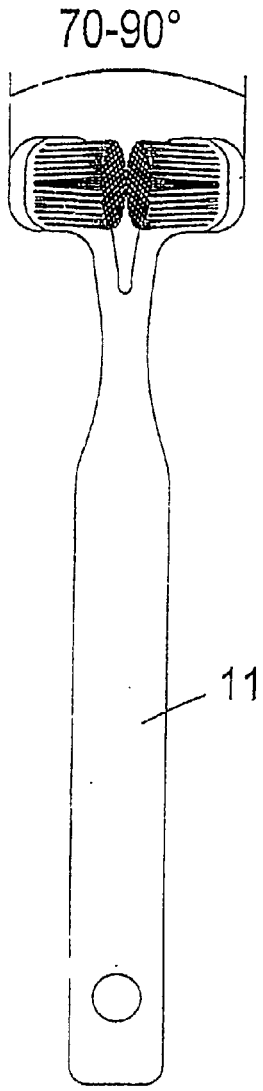
FIG. 2 shows a diagram of the front side (bristle side) of the finished toothbrush according to the invention.
Figure 3:
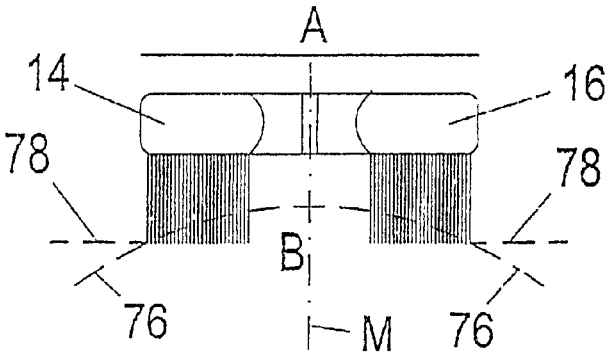
FIG. 3 shows a section of the toothbrush viewed from the front and in which intersecting lines are shown to illustrate how the bristle is cut after insertion.

The transition from the embodiment of the starting-material which is shown in FIG. 1 to the finished toothbrush which is shown in FIG. 2, means that the bristle-carrying head parts are bent until the ranks of bristle rows which lie closest to each other touch each other, or nearly touch each other. FIG. 3 indicates the profile of the surface of the rows of bristle that are inserted in the bristle-occupying hollow space of the two head parts, with the bristle being cut so that the bristle surface of each head part forms a gentle half-moon shaped indentation. By selecting a shape of the bristle in which the outermost ends are cut straight across and each bristle is split at the end into many small bristle parts with the aid of an operation called "flagging" and the remaining bristle groups are cut in an inclined plane in which the point of the bristle is made blunt by means of polishing in an operation called "end-rounding", one will get a toothbrush which is extra gentle to the gum and at the same time have thin bristle ends which get well into the gaps between the teeth and into small crevices and dents in the enamel. The splitting and rounding of the bristle ends occur continuously and automatically after the bristle is cut to the right length.

Figure 4:
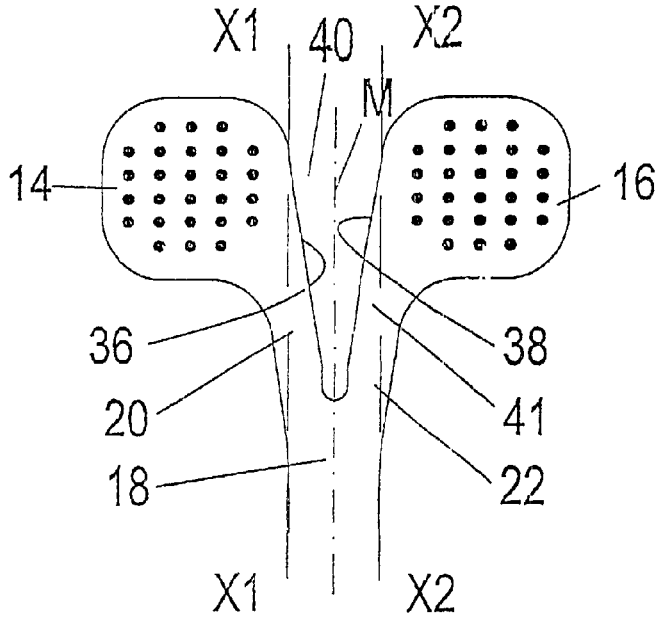
FIG. 4 shows the head parts of a toothbrush starting-material with an indication of the placement of the twisting axes of the head parts, X1 and X2 respectively.

In FIG. 4 the forward part of the toothbrush is shown with the two heads 14, 16 that are connected to the arms 20, 22. The inner sides 36, 38 of the head part, i.e. the sides that are lying nearest the centre-line M of the handle, runs on into the two arms 20, 22, such that an approximately V-shaped opening is formed. The inner sides 36, 38 run together in the centre-line M.

The aim of this solution is that the head parts 14, 16 shall be bent downwards around each respective axis X1 and X2, i.e. a bending of the head which occurs by way of the arms 20, 22 and which mainly means a twisting/deforming around the axis which is parallel to the main longitudinal direction of the head. This is to prevent the height dimensions of the toothbrush becoming too big so that it is difficult to use on the molars at the back of the mouth. To make this possible it is necessary to use specially formed new support bodies such as those that are now proposed according to the present invention.

The shaping appliance preferably comprises a stationary support section and a movable section to carry out the twisting. The upper side of the support section forms the support surface for the handle 12 of the toothbrush 11. Furthermore, the appliance comprises a wedge-shaped structure 80 which is adapted to be placed in the V-shaped space between the head parts. In addition, the appliance comprises a support surface, for example shaped as two parallel pins/taps 82, 84, around which the head parts 14, 16 are bent/twisted.

FIG. 5 shows the same as FIG. 4, are where the support body 80 with the essentially wedge-shaped structure 80 is inserted in the V-shaped spaced between the head parts 14, 16. To be more exact, the wedge-shaped structure 80 has a shape which fits very snugly into the space 40 (FIG. 1) between the heads parts 14, 16. This will ensure that the heads parts 14, 16, because of the exact fitting of the wedge to the space, cannot move towards each other during the bending/twisting around the arms, i.e. in that the resultant of the bending force acts inwards.

During the conversion into a finished toothbrush, a support body 83 is led forward, see FIGS. 5 and 6, towards and against the underside (between the bristle parts) of the heads parts 14, 16 and the arms 20, 22, and partially in under the handle 12(18). According to a preferred embodiment, which is shown in FIG. 6, such a support body is made from two pins which are led towards and against the underside of the heads and arms. After the support body 83 (or the pins 82, 84) is put in place, it exerts a force (preferably at a right angle) to the backsides of the head parts 14, 16, preferably after or simultaneously with the arms 20, 22 towards the head (the area indicated by the reference number 41 in FIG. 4) being softened by heating (hot air, ultrasound, high frequency, heating wire and the like). The heads are then twisted downwards in a twisting and deforming movement of the arms and their transition area towards the head (see 41 in FIG. 4), the twisting of which is regulated and is limited by the inserted wedge and the support body 83 (or the two pins 82, 84) as explained above. The twisting continues until the heads have acquired the desired angle with each other for application. The support structure is shown to the right in FIG. 5, with a triangular cross-section, this is so that the support structure shall not get in the way of the bristle when the bending takes place.

It is the parallel opposite edge parts of the support body (83) (alternatively the pins/taps 82, 84) which make up the support for the twisting/deforming, with the twisting occurring around these edges of the support body. The horizontal twisting and deforming itself occurs, in the main, in the arm part just behind the head.

Without the placement of the mentioned wedge, the inwardly directed force component arising from the vertical force would result in the movement of the heads towards each other and the V-shape between the heads would become more pointed.

By this use of wedge and support body, the deforming and twisting can occur without the arms, to any extent, leaving the plane in which they are originally lying.

This is in opposition to previous solutions in which the arms themselves, as opposed to them being twisted/deformed around a mainly horizontal axis, were bent downwards to such a large extent that the dimension of the head became so large that the toothbrush was uncomfortable and complicated to use, and thereby was without the necessary freedom of movement inside the mouth of the user.

In the FIGS. 7 and 8, a side-section of the two steps in which the toothbrush starting-material 10 is fitted to a block-formed support surface 50 is show. The foremost part of the toothbrush starting-material lies relatively free because it is easy to bend it downwards when the plastic of the arms is softened during the heating. FIG. 7 indicates with arrows how the wedge 80 and pins 82, 84 are led towards the right in position in the V-shaped space under the head parts respectively and thereby defining the two axes of twisting/ deformation X1 and X2, respectively, The structure marked by the reference number 90 indicates a body that shall impart the twisting force onto the head parts. After the arms have been heated up, the head parts are bent downwards so that they get a position as shown in FIG. 8. The heating can, of course, also occur during the downward bending itself. The structure 90 can also include nozzles to blow hot air against the arm parts so that these soften sufficiently, and can comprise regulating devices that can ensure correct twisting of the head parts.

It is a special feature of the new head construction that (according to FIG. 8) as a consequence of the special twisting procedure which is outlined above, one achieves a head of the toothbrush in which the diverging inner edges on the head parts and the upper sides of the arms in the U-shaped or V-shaped opening, form a tapered profile with decreasing height of the head part towards the foremost end of the head.

The finished formed head of the toothbrush is shown in FIG. 9. Marked in this figure with reference numbers 92, 94 are the arm parts (which connect the heads 16/14 to the handle 12(18)), and which are heated and subjected to twisting and deformation during the forming operation.

The present invention represents a great advance in that the toothbrush has limited dimensions in the height direction so that it can, in a more gentle way, effectively brush those areas of the mouth where it is cramped, such as by the back molars. In FIG. 8, the height extension of the toothbrush is shown by the letter H, which is estimated from the underside of the head parts (i.e. without bristle) to the joining points of the arms (where the arms run together) on the topside. The height extension H of the head part is at the most 1.5 cm, preferably in the range 1.0–1.3 cm, and especially preferred about 1.2 cm. With a height extension such as H, the toothbrush will be comfortable and easy to use.

Furthermore, to achieve a toothbrush with suitable small dimensions with best possible application characteristics, the distance A (see FIG. 3) between the extreme edges of the head when the starting-material is laying flat, ought to be at the most 3.5 cm, and preferably in the range 2–3.5 cm. Furthermore, the distance between the inner bristle rows of the two head parts is in the range 1.2–1.5 cm.

By the invention an embodiment is described, in which two pins positioned in parallel is used to regulate the movements of the toothbrush with only two heads. The support body can for the rest, instead of taps, comprise a solid tap or block which is pushed under and against the heads and the arms, and between the bristle parts. There is thus described a method in which the toothbrush is manufactured in that the two head parts are prepared separately, are bent downwards by a twisting/deformation of the arms which connect the head parts to the handle, and without the head parts being subjected to any forward-downwards bending across the twisting axes of the head parts. The diverging inner edges of the head parts and the upper sides of the arms, in the U- and V-shaped opening, form a profile with an evenly decreasing height of the head part towards the foremost end of the head. The gently decreasing height, which is apparent when one looks at the finished toothbrush from the side, arises from the inner side surfaces 36, 38 of the starting-material (FIG. 1) initially being mutually diverging, Thus, the heads are not bent downwards in a forward direction across the axes X1 and X2 respectively.

By the invention is provided a new construction of the head part of a toothbrush, which makes it possible to complete its shape in one step according to the invention as it is explained above.

The invention claimed is:

1. A method of producing a toothbrush from a blank, said blank comprising a handle portion, a neck portion and two diverging arm portions, each arm portion having a head portion with bristles, both head portions being located in a plane through a center line of said blank, and said bristles extending rectilinearly outwards from said center line, said method comprising the steps of:

placing said blank in a shaping device;

arranging a bottom side of said arm and head portions at a blank support body, wherein the support body has two mutually parallel pins have oppositely directed side faces having contact lines of the support body;

bending said arm and head portions via torsion twisting around said blank support body to a desired angle position along a respective one of two axes formed by contact lines of said blank support body, said two axes extending approximately parallel to said center line of said blank and approximately level with the bottom side of said neck portion;

wherein said step of bending causes said head portions to extend in downwards diverging directions with respect to said handle and neck portions, with a top side of said head portion extending downwards from a level of the center line of said blank and with the bottom side of said head portions extending downwards from a level of the bottom side of the neck portion.

2. The method according to claim 1, further comprising arranging a rigid support structure in a spacing between said two diverging arm and head portions, said rigid support structure having a shape approximately corresponding to a shape of said spacing.

3. The method according to claim 2, wherein said rigid support structure is wedge-shaped.

4. The method according to claim 1, wherein during said step of bending, the blank support body has two opposed side edges running parallel to said blank center line.

5. A device for producing a toothbrush having a handle portion, a neck portion, two arm portions and a bristle carrying head portion at the outer end of each arm portion, including twisting and deforming said two arm portions to form an angle of about 90° between the head portion of each arm portion, comprising:

a support body for supporting the toothbrush blank, said support body supporting at least said arm portions during a torsion twist bending of said arm portions along contact lines provided by said support body, wherein the support body forms two contact lines to support the arm portions to maintain their level during bending, and wherein the support body comprises two mutually parallel pins supporting the arm portions by means for mutually opposite side lines extending along the bottom side of the blank; and means for softening relevant blank portions.

6. The device according to claim 5, further comprising a rigid structure located in a spacing between said two arm portions and said two head portions, said structure having a shape which approximately corresponds to said spacing.

7. The device according to claim 6, wherein the rigid structure is of a shape selected from the group consisting of V-shaped and wedge-shaped.

8. The device according to claim 5, wherein said support body has two edges extending parallel to the center line of the blank.

* * * * *